US008164985B2

(12) United States Patent
Su

(10) Patent No.: US 8,164,985 B2
(45) Date of Patent: Apr. 24, 2012

(54) TIME DISPLAY DEVICE AND TIME DISPLAY METHOD THEREOF

(75) Inventor: Xiao-Guang Su, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 299 days.

(21) Appl. No.: 12/610,365

(22) Filed: Nov. 2, 2009

(65) Prior Publication Data

US 2011/0075524 A1 Mar. 31, 2011

(30) Foreign Application Priority Data

Sep. 30, 2009 (CN) ..... 2009 1 0308023

(51) Int. Cl.
*G04C 19/00* (2006.01)
*G04C 19/02* (2006.01)

(52) U.S. Cl. ..... 368/82; 368/226; 368/240

(58) Field of Classification Search ..... 368/82–84, 368/239, 240, 223, 226
See application file for complete search history.

(56) References Cited

U.S. PATENT DOCUMENTS 1,096,779 A * 5/1914 Clement ..... 368/240
3,626,410 A * 12/1971 deKoster ..... 340/815.83
3,823,549 A * 7/1974 Feldman ..... 368/82
3,922,847 A * 12/1975 Culley et al. ..... 368/240
3,987,617 A * 10/1976 Slob ..... 368/242
4,007,583 A * 2/1977 Johnson ..... 368/29
4,149,368 A * 4/1979 Nakamura et al. ..... 368/240
4,370,068 A * 1/1983 Han ..... 368/240
4,400,092 A * 8/1983 Piquet et al. ..... 368/82
4,920,524 A * 4/1990 Kotob ..... 368/240
5,410,520 A * 4/1995 Stampfer ..... 368/240
5,694,376 A * 12/1997 Sullivan ..... 368/82
6,256,265 B1 * 7/2001 Sepulveda ..... 368/82
6,556,513 B2 * 4/2003 Wimberly ..... 368/82
6,690,623 B1 * 2/2004 Maano ..... 368/82
7,835,231 B1 * 11/2010 Garcia ..... 368/223
2011/0038232 A1 * 2/2011 Su et al. ..... 368/82

* cited by examiner

*Primary Examiner* — Vit Miska
(74) *Attorney, Agent, or Firm* — Altis Law Group, Inc.

(57) ABSTRACT

A time display device comprises a dial plate; a plurality of time indication portions set in the dial plate; and a plurality of groups of luminophors. Each of the groups of luminophors corresponds to a time indication portion, and comprises a first luminophor, a second luminophor, and a third luminophor. A clock unit provides current time information. A first switch unit electrifies/powers off the first luminophor. A second switch unit electrifies/powers off the second luminophor. A third switch unit electrifies/powers off the third luminophor. A hour hand controlling module obtains a hour value, and controls the first switch unit to electrify the first luminophor of the time indication portion corresponding to the obtained hour value. A minute hand controlling module obtains the current minute value, and controls the second switch and/or the third switch unit to electrify the corresponding luminophor.

11 Claims, 5 Drawing Sheets

TIME DISPLAY DEVICE AND TIME DISPLAY METHOD THEREOF

BACKGROUND

1. Technical Field

The present disclosure relates to a time display device and a time display method thereof.

2. Description of Related Art

In general, a time display device includes a hour hand and a minute hand. The hour hand and the minute hand periodically rotate to indicate a different clock graduation for showing a current time respectively. However, for person with poor-sight, it is difficult to see a position indicated by the hour hand and the minute hand on the time display device.

Therefore, what is needed is a time display device which can show a current via luminophors.

DETAILED DESCRIPTION

Figure 1:
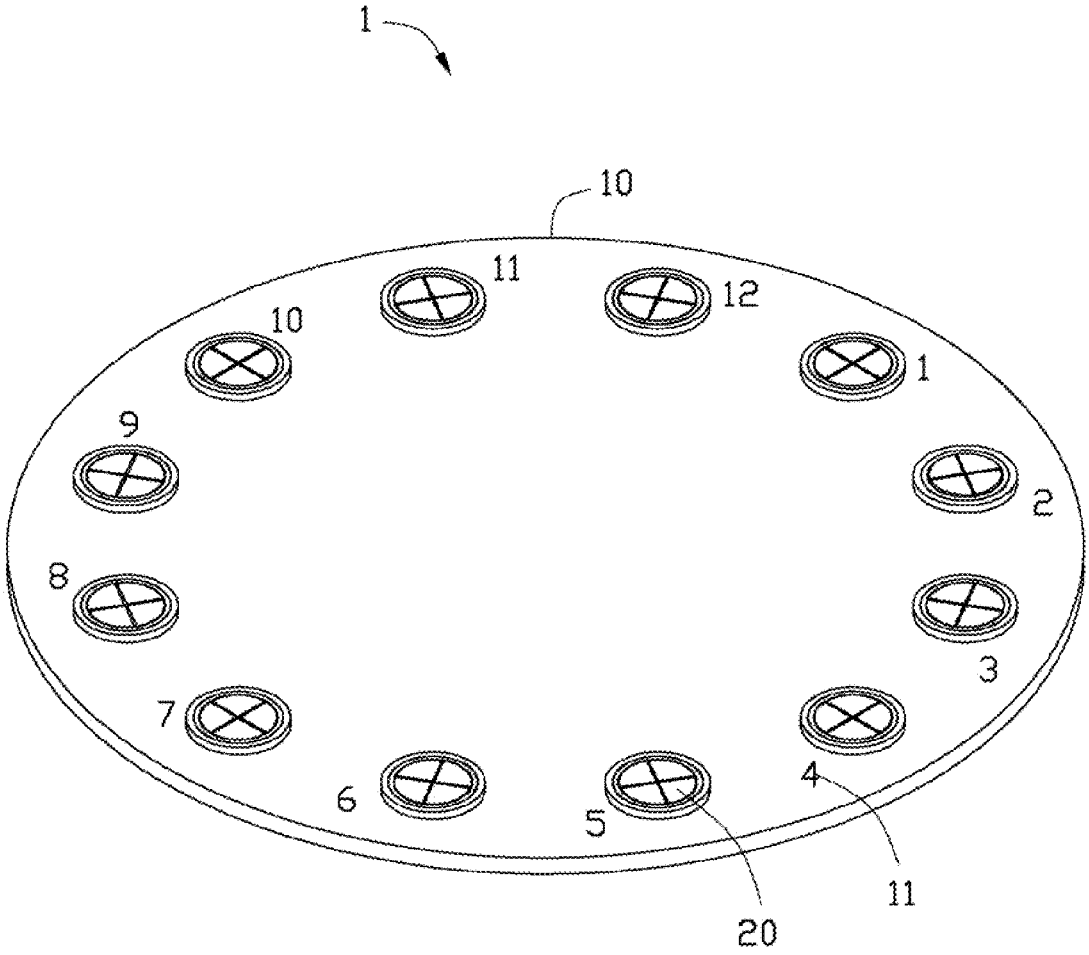
FIG. 1 is an isometric view of a time display device in accordance with an exemplary embodiment.

FIG. 1 is an isometric view of a time display device in accordance with an exemplary embodiment. The time display device 1 includes a dial plate 10 and a plurality of time indication portions 11 set in the dial plate 10. The time indication portion 11 is configured for indicating the time. In the exemplary embodiment, the dial plate 10 is disc-shaped. The number of the plurality of time indication portion 11 is twelve.

Figure 2:
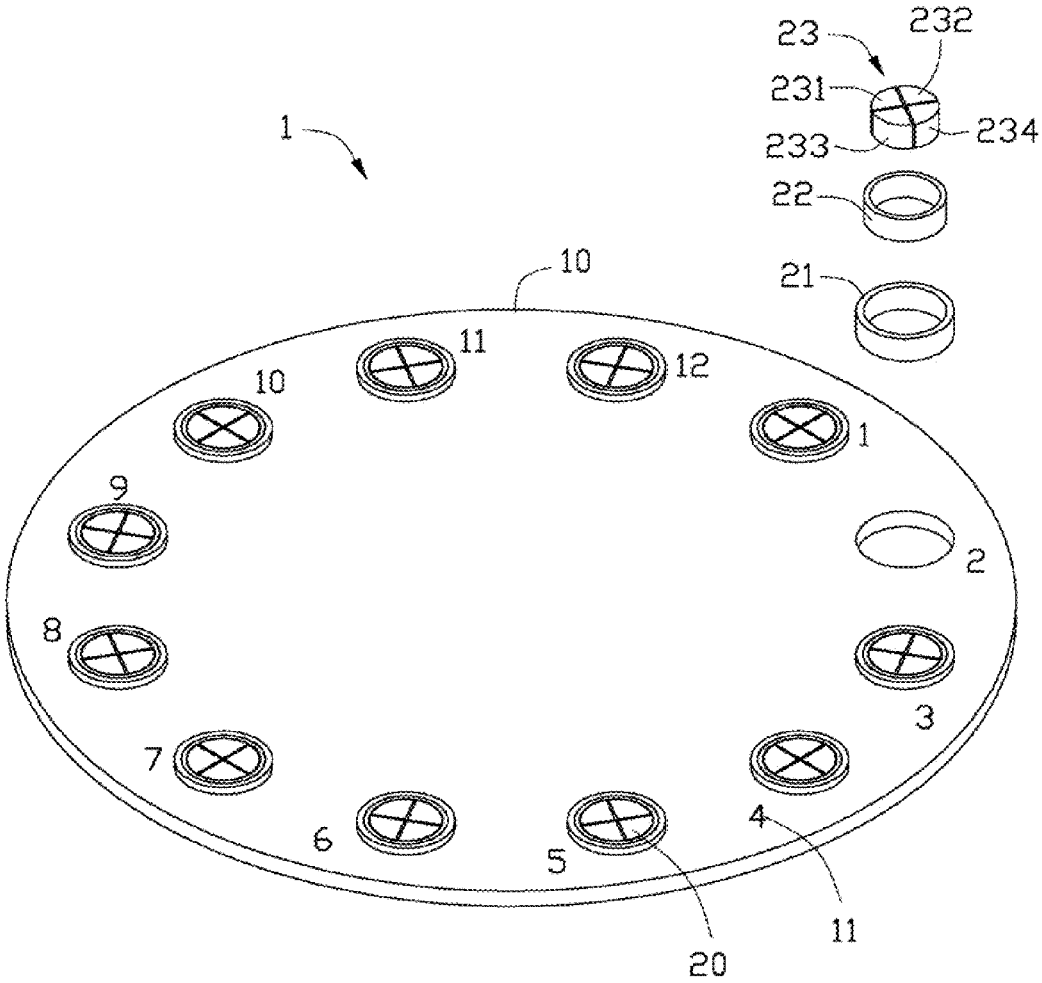
FIG. 2 is a partially exploded view of the time display device of FIG. 1.

Referring to FIG. 2, the time display device 1 further includes a plurality of groups of luminophors 20. Each of the groups of the luminophors 20 corresponds to a time indication portion 11, and includes a first luminophor 21, a second luminophor 22, and a third luminophor 23. The second luminophor 22 is received by the first luminophor 21. The third luminophor 23 is received by the second luminophor 22, and is composed with four sub-luminophors 231, 232, 233, and 234. In the exemplary embodiment, the first luminophor 21 and the second luminophor 22 are round ring-shaped. The first luminophor 21, the second luminophor 22 and the third luminophor 23 are light-emitting diodes (LEDs), which may emit the same colors light, or emit the different colors light.

In the exemplary embodiment, a current time is shown for user to view via a combination of the first luminophor 21, the second luminophor 22 and the third luminophor 23.

The first luminophor 21 is configured for indicating an hour value when it emits light. The second luminophor 22 and the third luminophor 23 are configured for indicating a minute value when the luminophor 22 and/or the third luminophor 23 emit light. In the exemplary embodiment, the minute value is obtained as a result of adding the number indicated by the lighting second luminophor 22 and the number indicated by the lighting third luminophor 23. The number indicated by the lighting second luminophor 22 is obtained by multiplying the scale value of the second luminophor 22 by 5, and the number indicated by the lighting third luminophor 23 is obtained as a sum of the number of lighting sub-luminophors. For example, when the first luminophor 21 of the twelfth time indication portion 11 emits light, the second luminophor 22 of the third time indication portion 11 emits light, and the sub-luminophors 231 and 232 of the third luminophor 23 of the third time indication portion 11 emits light, the hour value is 12, and the minute value is equal to $3\times5+2=17$, that is, the current time is seventeen minutes past twelve (12:17).

For understanding this disclosure, the following is a detailed exemplary embodiment.

Figure 3:
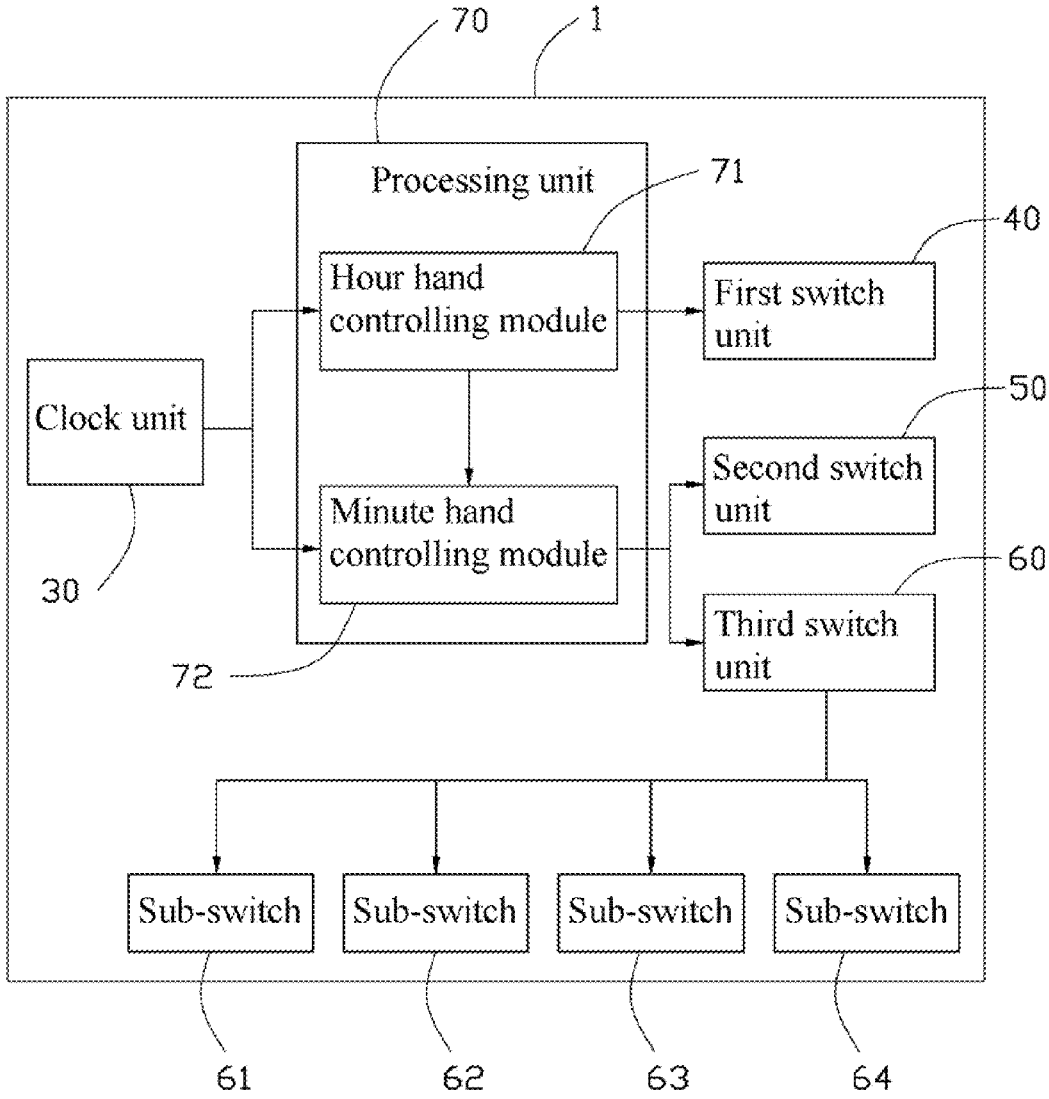
FIG. 3 is a block diagram of the hardware infrastructure of the time display device of FIG. 1 in accordance with an exemplary embodiment.

Referring to FIG. 3, the time display device 1 further includes a clock unit 30, a first switch unit 40, a second switch unit 50, a third switch unit 60, and a processing unit 70.

The clock unit 30 is configured for providing a current time information. In the exemplary embodiment, the current time information includes a current hour value and a current minute value.

The first switch unit 40 is configured for electrifying/powering off the first luminophor 21.

The second switch unit 50 is configured for electrifying/powering off the second luminophor 22.

The third switch unit 60 is configured for electrifying/powering off the third luminophor 23. In the exemplary embodiment, the third switch unit 60 includes four sub-switches 61, 62, 63 and 64, each of which is configured for electrifying/powering off one of the sub-luminophors of the third luminophors 23.

The processing unit 70 includes a hour hand controlling module 71 and a minute hand controlling module 72.

Figure 4:
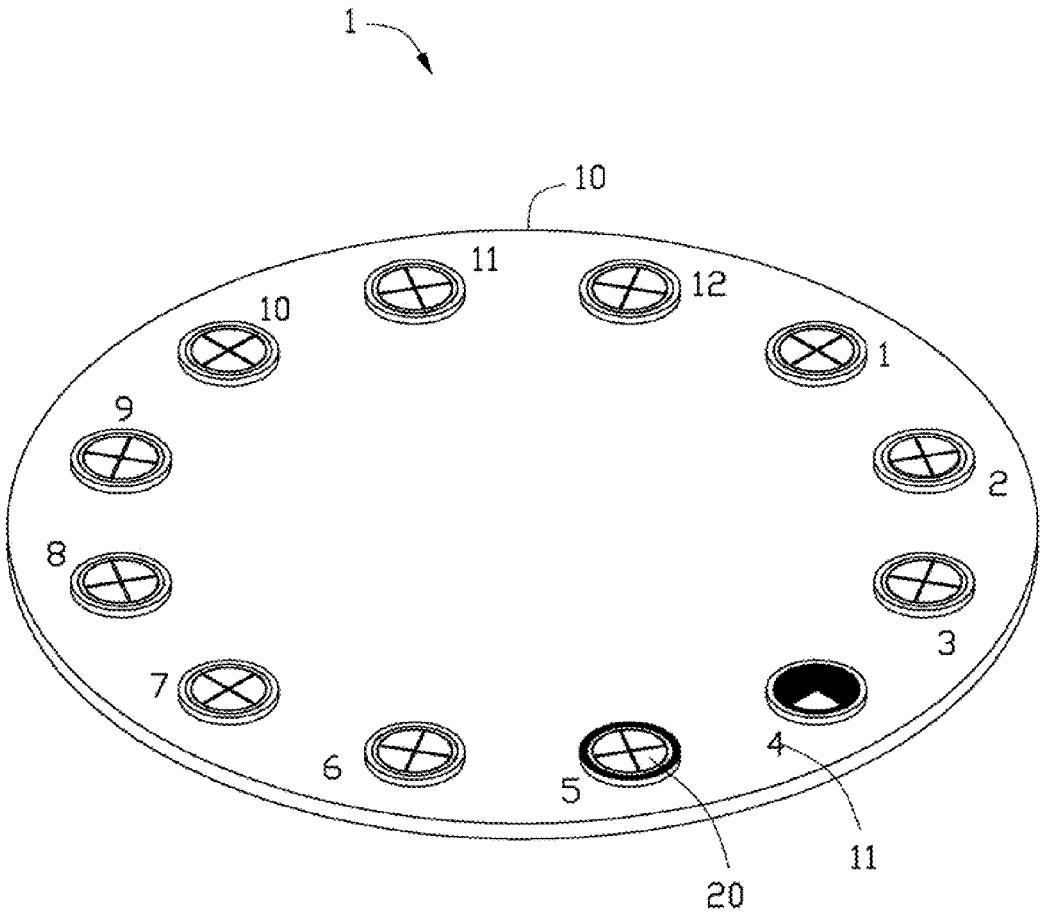
FIG. 4 is a schematic diagram of the time display device.

The hour hand controlling module 71 is configured for obtaining the hour value from the provided current time information, and controlling the first switch unit 40 to electrify the first luminophor 21 of the time indication portion 11 corresponding to the obtained hour value. As shown in FIG. 4, the current hour value is 5; the first switch unit 40 electrifies the first luminophor 21 of the fifth time indication portion 11.

The minute hand controlling module 72 is configured for obtaining the current minute value from the provided time information, and controlling the second switch 50 and/or the third switch unit 60 to electrify the corresponding luminophor. Detaily, the minute hand controlling module 72 divides the obtained minute by 5 to generate an integer quotient and a remainder, determines the time indication portion 11 according to the integer quotient, and controls the second switch unit 50 to electrify the second luminophor 22 of the determined time indication portion 11, and controls the sub-switches of the third switch unit 60 to electrify the corresponding sub-luminophors of the third luminophor 23 according to the remainder. For example, as shown in FIG. 4, the current minute value is 23, the minute hand controlling module 72 divides 23 by 5 to generate an integer quotient 4 and a remainder 3, determines the time indication portion 11 according to the integer quotient 4, and controls the second switch unit 50 to electrify the second luminophor 22 of the fourth time indication portion 11, and controls the sub-switches 61,62, and 63 of the third switch unit 60 to electrify the corresponding sub-luminophors 231, 232 and 233 of the third luminophors 23 of the third luminophor 23 according to the remainder 3.

Figure 5:
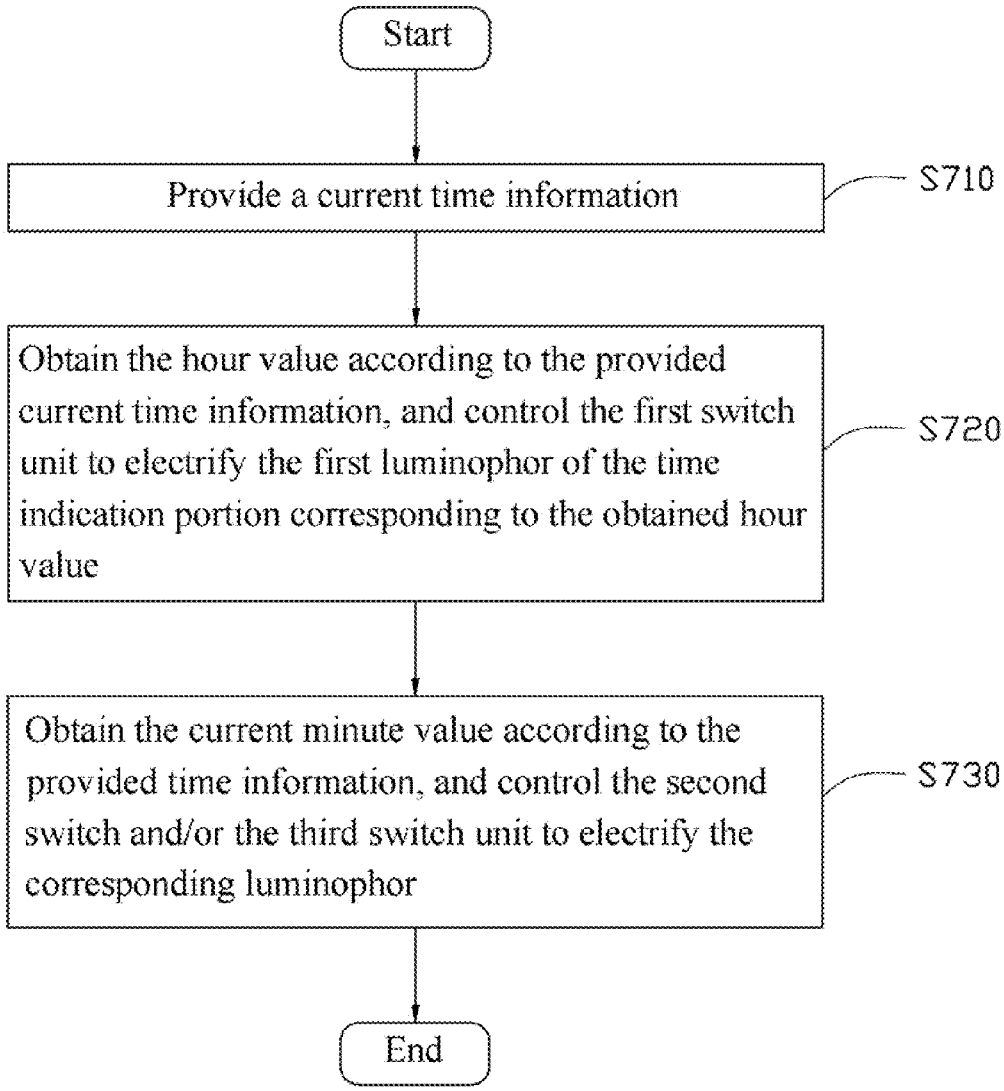
FIG. 5 is a flowchart of a time display method implemented by the time display device of FIG. 1, in accordance with an exemplary embodiment.

FIG. 5 is a flowchart of a time display method implemented by the time display device of FIG. 1, in accordance with an exemplary embodiment.

In step S710, the clock unit 30 provides a current time information.

In step S720, the hour hand controlling module 71 obtains the hour value according to the provided current time information, and controls the first switch unit 40 to electrify the first luminophor 21 of the time indication portion 11 corresponding to the obtained hour value.

In step S730, the minute hand controlling module 72 obtains the current minute value according to the provided time information, and controls the second switch 50 and/or the third switch unit 60 to electrify the corresponding luminophors.

Although the present disclosure has been specifically described on the basis of the exemplary embodiment thereof, the disclosure is not to be construed as being limited thereto. Various changes or modifications may be made to the embodiment without departing from the scope and spirit of the disclosure.

What is claimed is:

1. A time display device comprising:

a dial plate;

a plurality of time indication portions set in the dial plate, and configured for indicating a time;

a plurality of groups of luminophors, each of which corresponds to a time indication portion, and comprises a first luminophor, a second luminophor received by the first luminophor, and a third luminophor received by the second luminophor;

a clock unit configured for providing a current time information;

a first switch unit configured for electrifying/powering off the first luminophor;

a second switch unit configured for electrifying/powering off the second luminophor;

a third switch unit configured for electrifying/powering off the third luminophor;

a hour hand controlling module configured for obtaining a hour value from the provided current time information, and controlling the first switch unit to electrify the first luminophor of the time indication portion corresponding to the obtained hour value; and a minute hand controlling module configured for obtaining the current minute value from the provided time information, and controlling the second switch and/or the third switch unit to electrify the corresponding luminophor.

2. The time display device as claim 1, wherein the first luminophor, the second luminophor and the third luminophor emit the same colors light.

3. The time display device as claim 1, wherein the first luminophor, the second luminophor and the third luminophor emit the different colors light.

4. The time display device as claim 1, wherein the third luminophor comprises a plurality of sub-luminophors, the number indicated by the second lumophor is obtained by multiplying the scale value of the second luminophor by 5, and the number indicated by the third luminophor is obtained as a sum of the number of sub-luminophors.

5. The time display device as claim 4, wherein the third switch unit comprises four sub-switches, and the minute hand controlling module divides the obtained minute by five to generate an integer quotient and a remainder;

determines the time indication portion according to the integer quotient; and controls the second switch unit to electrify the second luminophor of the determined time indication portion, and controls the sub-switches of the third switch unit to electrify the corresponding sub-luminophors of the third luminophor according to the remainder.

6. The time display device as claim 1, wherein the number of the plurality of time indication portion is twelve.

7. A time display method implemented by a time display device, which comprises a dial plate; a plurality of time indication portions set in the dial plate; a plurality of groups of luminophors, each of which corresponds to a time indication portion, and comprises a first luminophor, a second luminophor received by the first luminophor, and a third luminophor received by the second luminophor; the method comprising:

providing a current time information;

obtaining a hour value from the provided current time information, and controlling the first switch unit to electrify the first luminophor of the time indication portion corresponding to the obtained hour value; and a minute hand controlling module configured for obtaining the current minute value from the provided time information, and controlling the second switch and/or the third switch unit to electrify the corresponding luminophor.

8. The time display method as claim 7, wherein first luminophor, the second luminophor and the third luminophor emit the same colors light.

9. The time display method as claim 7, wherein the first luminophor, the second luminophor and the third luminophor emit the different colors light.

10. The time display method as claim 7, wherein the third luminophor comprises a plurality of sub-luminophors, the display device electrifying the second luminophor and the third luminophor step comprises:

dividing the obtained minute by five to generate an integer quotient and a remainder;

determining the time indication portion according to the integer quotient; and electrifying the second luminophor of the determined time indication portion, and electrifying the corresponding sub-luminophors of the third luminophor according to the remainder.

11. The time display method as claim 7, wherein the number of the plurality of time indication portion is twelve.

* * * * *